United States Patent [19]

Suzuki

[11] 4,326,862

[45] Apr. 27, 1982

[54] AIR CLEANER FOR ENGINES, HAVING BACK FLOW GAS SHUT-OFF FUNCTION

[76] Inventor: Nagatoshi Suzuki, 5-7-7, Kugahara, Ohta-ku, Tokyo, Japan

[21] Appl. No.: 158,129

[22] Filed: Jun. 10, 1980

[51] Int. Cl.[3] ..... B03C 3/14

[52] U.S. Cl. ..... 55/127; 55/128; 55/417; 55/DIG. 28; 123/198 D

[58] Field of Search ..... 55/105, 127, 128, 139, 55/417, DIG. 28, 126; 123/52 MF, 198 D

[56] References Cited

U.S. PATENT DOCUMENTS

| | | | |
|---|---|---|---|
| 1,492,433 | 4/1924 | Dileo | 55/417 |
| 2,556,832 | 6/1951 | Vollrath | 55/128 |
| 2,696,273 | 12/1954 | Wintermute | 55/127 |
| 2,841,240 | 7/1958 | Wintermute | 55/127 |
| 2,912,003 | 11/1959 | Lagerwey | 55/417 |
| 3,406,669 | 10/1968 | Edwards | 55/139 |

FOREIGN PATENT DOCUMENTS

| | | | |
|---|---|---|---|
| 421011 | 5/1947 | Italy | 123/52 MF |

*Primary Examiner*—David L. Lacey
*Attorney, Agent, or Firm*—Lane, Aitken, Kice & Kananen

[57] ABSTRACT

This invention discloses an air cleaning device for engines which is provided with a check valve within the induction pipe thereof to check the back flow of mixed fuel gas, and thereby prevent the engine back fire, particularly an intake air cleaner for engines in which a cyclone type dust collector having an electrostatic filter is used. In this invention is disclosed a device which can prevent the ignition of the mixed fuel gas and thereby avoid explosion of the said gas.

5 Claims, 4 Drawing Figures

AIR CLEANER FOR ENGINES, HAVING BACK FLOW GAS SHUT-OFF FUNCTION

BACKGROUND OF THE INVENTION

1. Field of the Invention

This invention relates to an air cleaning device for internal combustion engines, having a back flow gas shut-off function, wherein a back flow gas check valve is provided in an air induction pipe connected with a cyclone type dust collection device and the closing of said valve serves to stop the application of high voltage.

2. Brief Description of the Prior Art

Hitherto, this type of air cleaning device for engines having such a back flow gas shut-off function has not existed in the known art. The air cleaner for engines, employing an electrostatic filter, has a very high dust collection efficiency and also high marketability and mass productivity.

However, the discharge wire or plate is applied with as high a voltage as possible to charge dust in the atmosphere with electricity, so that sparking discharge may occur between the positive and negative poles when the insulation between them deteriorates.

As a result, there is the danger of explosion if the engine induces backfire and the mixed fuel gas flows back from the carburetor located near the manifold into the electrostatic filter through the air induction pipe.

SUMMARY OF THE INVENTION

The object of this invention is to provide an air cleaner for engines, where a back flow gas check valve is provided within the air induction pipe to check the backfire from the engine.

Another object of this invention is to provide a device to prevent the back flow of mixed fuel gas, in the air cleaner which is provided with a cyclone type dust collector having the electrostatic filter.

Still another object of this invention is to provide a switch to shut off the high voltage from a high voltage generator, the said switch being turned on by the closing of the said back flow gas check valve provided within the said air induction pipe.

DESCRIPTION OF THE PREFERRED EMBODIMENTS

Figure 1:
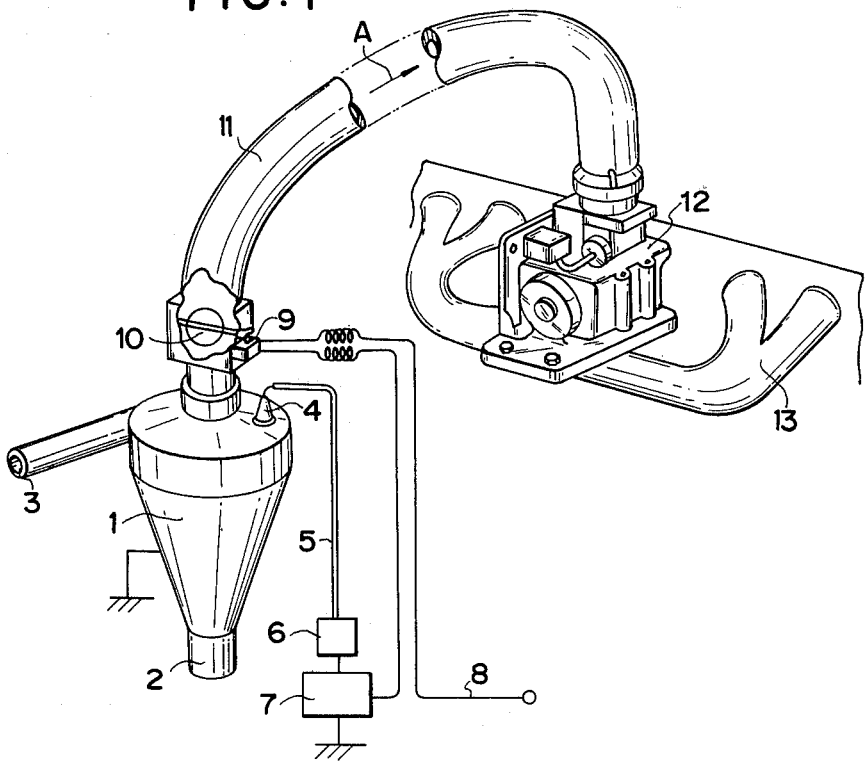
FIG. 1 shows a perspective view of a first preferable embodiment of the air cleaner for engines having the back flow gas shut-off function according to this invention.
Figure 2:
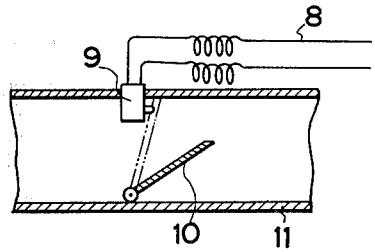
FIG. 2 shows an enlarged cross section of the configuration of the back flow gas check valve and the switch of the first preferable embodiment in FIG. 1.

With a view to preventing such dangerous explosion as mentioned above, this invention provides an air cleaning device for engines, having a novel back flow gas shut-off function, in which a back flow gas check valve and a switch are installed in the air induction pipe to shut off the back flow gas, and, at the same time, stop the application of high voltage.

Preferable embodiments of the engine air cleaner having the back flow gas shut-off function according to this invention will hereinafter be described in detail in reference to the accompanying drawings.

The numeral 1 denotes a cyclone type dust collection device provided with an electrostatic filter. The numeral 2 denotes a dust pit.

The dust collector 1 further includes an air intake 3, a high voltage terminal 4 for applying high voltage to a discharge plate of the electrostatic filter, and a high tension cable 5 connecting the high voltage terminal 4 through a rectifier 6 to a high voltage generator 7. The high voltage generator 7 is connected to a power source by a lead wire 8 which is interrupted by a switch 9, such as a microswitch. The switch 9 is actuated by the closing of a back flow gas check valve 10, such as a butterfly valve. An air induction pipe 11 connects the cyclone type dust collector 1 to the carburetor 12 of an engine which also includes a manifold 13.

Now the operation will be explained.

When the engine is started up, air which was drawn through the air intake 3 passes through the electrostatic filter in the cyclone type dust collector 1, opens the back flow gas check valve 10 by the suction pressure of the engine, flows in the direction of the arrow A and enters the carburetor 12. At the same time, the air flow closes the switch 9 to electrify the high voltage generator 7.

When the engine has backfired for some reason and injects the mixed fuel gas back into the induction pipe 11 through the carburetor 12, the back flow gas check valve 10 is closed by the pressure of said gas flow, opening the switch 9 and cutting off the high voltage power source. As a result, there is no ignition of the back flowing mixed fuel gas and safety is assured. There is no danger of explosion by firing of the mixed fuel gas.

Figure 3:
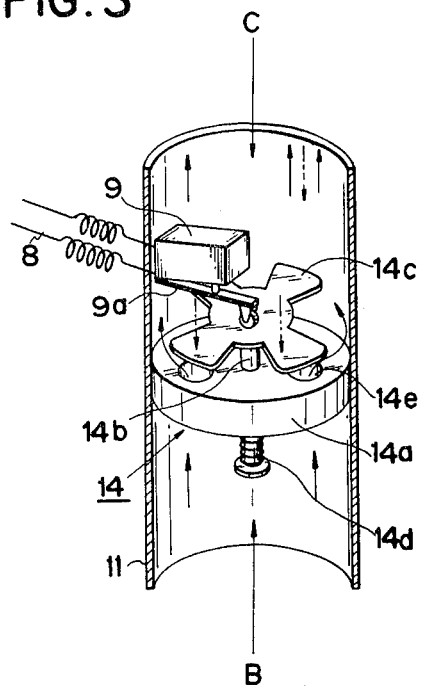
FIG. 3 shows an enlarged cross section of a second preferable embodiment of the back flow gas check valve according to this invention.

Next, the second preferable embodiment of the back flow gas check valve will be explained referring to FIG. 3, wherein the induction pipe 11 incorporates the back flow gas check valve 14 therein.

The back flow gas check valve 14 comprises a valve seat **14*a*, a movable shaft 14*b*, a valve leaf 14*c* and a spring 14*d*. The said valve seat 14*a* has a desired number of apertures 14*e* at the circumference thereof. The switch 9 is, for example, a microswitch which is in contact with a valve element such as the valve leaf 14*c* via a movable piece 9*a***.

The operation, when cleaned air has flowed into the said valve 14 from the direction of the arrow B, it compresses the spring **14*d* which is wound around the movable shaft 14*b* and opens the closed apertures 14*e*, flowing toward the carburetor 12 of the engine. At this time, the air flow lifts the movable piece 9*a* which in turn presses the push button of the switch 9** to apply high voltage to the electrostatic filter.

Now when the back flow gas enters from the direction of the arrow C, the spring **14*d* is extended and the valve leaf 14*c* closes the apertures 14*e* of the valve seat 14*a*. At the same time, the switch 9** is opened to shut off the high voltage.

Thus, the back flow gas is intercepted by the back flow gas check valve 14.

A third preferred embodiment, which uses a back flow gas check valve 14' as the check valve, will be explained.

Figure 4:
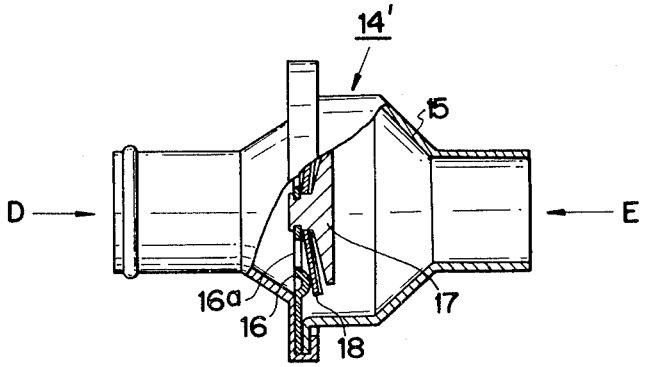
FIG. 4 shows an enlarged cross section of a third preferable embodiment of the said valve according to this invention.

As is illustrated in FIG. 4, a housing 15 is incorporated in the induction pipe 11. A draft plate 16 is fixed within the housing 15, and a stopper 17 is fixed at the center of the draft plate 16. A valve 18 is fixed on a shaft of the stopper 17, covering draft apertures 16*a* provided at the circumference of the draft plate 16.

The operation will now be explained. When the cleaned air flows in the direction of arrow D, it is sent into the carburetor 12 of engine through the draft apertures 16*a*. In the event of back flow from the direction of the arrow E, the valve 18 will close the draft apertures 16*a* and prevent the back flow gas from entering the electrostatic filter and the cyclone type dust collector 1.

Having the construction and operation as mentioned above, the air cleaner for engines, having the back flow gas shut-off function, according to this invention has the following effects.

The back flow gas check valve is provided within the induction pipe prevents the entrance into the electrostatic filter of the back flow fuel gas from the carburetor, and the switch provided is activated by the closing of said back flow gas check valve to shut off the application of high voltage, so that the possibility of dangerous explosion due to ignition of the mixed fuel gas is completely eliminated.

The use of the device according to this invention in an electrostatic filter type air cleaner for engines will eliminate the danger of the mixed fuel gas flowing back by backfire being ignited into explosion by the sparking discharge from the high voltage electrostatic filter. This device can further be applied for other various purposes.

I claim:

1. In an air cleaner for engines having a cyclone dust collector provided with an air intake and incorporating an electrostatic filter, an air induction pipe connecting said cyclone dust collector to the engine, and a high voltage generator connected to the electrostatic filter for applying high voltage to the electrostatic filter, the improvement comprising the air cleaner including a back flow gas check valve provided within said induction pipe and a switch connected to the high voltage generator and positioned and arranged with respect to the valve such that the switch is activated by the closing of said valve to stop the operation of said high voltage generator.

2. The apparatus according to claim 1 wherein the back flow gas check valve and the switch to stop the operation of the high voltage generator are fixed on an inner wall of said induction pipe.

3. The apparatus according to claim 1 or 2 wherein the switch is a microswitch and the valve is a butterfly valve.

4. In an air cleaner for engines having a cyclone dust collector provided with an air intake and incorporating an electrostatic filter, an air induction pipe for connecting said cyclone dust collector to the engine and a high voltage generator connected to the electrostatic filter for applying high voltage to the electrostatic filter, the improvement comprising a valve seat located within the induction pipe and defining an aperture, a valve element positioned and arranged for opening and closing the aperture of said valve seat to prevent the flow of back flow gas, and a switch connected to the high voltage generator and positioned and arranged with respect to the valve such that the switch is operated by the closing of the aperture by said valve element to shut off the high voltage generator.

5. The apparatus according to claim 4 wherein the valve element is in the shape of a leaf.

* * * * *